US007416207B2

(12) United States Patent
Poellmann

(10) Patent No.: US 7,416,207 B2
(45) Date of Patent: Aug. 26, 2008

(54) SLIDING BOARD, PARTICULARLY A SKI, AND A METHOD FOR THE PRODUCTION THEREOF

(75) Inventor: Edgar Poellmann, Vienna (AT)

(73) Assignee: Tyrolia Technology GmbH (AT)

( * ) Notice: Subject to any disclaimer, the term of this patent is extended or adjusted under 35 U.S.C. 154(b) by 180 days.

(21) Appl. No.: 10/547,833

(22) PCT Filed: Feb. 20, 2004

(86) PCT No.: PCT/EP2004/001653

§ 371 (c)(1),
(2), (4) Date: Aug. 30, 2005

(87) PCT Pub. No.: WO2004/078283

PCT Pub. Date: Sep. 16, 2004

(65) Prior Publication Data

US 2006/0175801 A1 Aug. 10, 2006

(30) Foreign Application Priority Data

Mar. 7, 2003 (AT) ..... A 350/2003

(51) Int. Cl.
*A63C 5/00* (2006.01)

(52) U.S. Cl. ..... 280/601; 280/607

(58) Field of Classification Search ..... 280/601, 280/607, 617

See application file for complete search history.

(56) References Cited

U.S. PATENT DOCUMENTS

| | | | | |
|---|---|---|---|---|
| 5,207,445 | A * | 5/1993 | Hoelzl | 280/607 |
| 5,445,403 | A * | 8/1995 | Cazaillon et al. | 280/610 |
| 5,544,908 | A * | 8/1996 | Fezio | 280/610 |
| 5,836,604 | A | 11/1998 | Piegay | |
| 5,871,223 | A * | 2/1999 | Zanco | 280/607 |
| 6,641,162 | B2 * | 11/2003 | Allmann et al. | 280/607 |
| 6,994,369 | B2 * | 2/2006 | Restani | 280/610 |
| 7,011,331 | B2 * | 3/2006 | Riepler | 280/601 |

FOREIGN PATENT DOCUMENTS

| | | | |
|---|---|---|---|
| EP | 1 161 972 | A2 | 12/2001 |
| EP | 1 380 323 | A1 | 1/2004 |
| WO | WO 01/45810 | A1 | 6/2001 |

* cited by examiner

*Primary Examiner*—Christopher Ellis
*Assistant Examiner*—Brian Swenson
(74) *Attorney, Agent, or Firm*—Ostrolenk, Faber, Gerb & Soffen, LLP

(57) ABSTRACT

A sliding board, particularly a ski, comprising a sliding surface, an upper shell, a core, optional steel edges, an upper belt and a lower belt, and comprising at least one interface element, which is joined by means of at least one anchoring element to the sliding board body and which is provided for mounting at least one binding element on the top surface of the sliding board. The anchoring element sits inside a holding location, which is provided or made in the core and when the anchoring element is already inserted has been fixed in the holding location by foaming during the production of the sliding board.

22 Claims, 2 Drawing Sheets

SLIDING BOARD, PARTICULARLY A SKI, AND A METHOD FOR THE PRODUCTION THEREOF

CROSS REFERENCE TO RELATED APPLICATION

The present application is a 35 U.S.C. §371 national phase conversion of PCT/EP2004/001653 filed Feb. 20, 2004, which claims priority of Austrian application no. A 350/2003 filed Mar. 7, 2003, which are incorporated herein in their entirety.

BACKGROUND OF THE INVENTION

1. Field of the Invention

The invention relates to a sliding board, in particular a ski, with a running surface, an upper shell, and a core, optionally with steel edges, an upper web and a lower web, and with at least one interface element, connected to the sliding board body by means of at least one anchoring element, for arranging at least one binding element on the upper side of the sliding board.

The invention also relates to a method for the production of a sliding board, in particular a ski, in which a running surface, a core, an upper shell, and optionally steel edges, an upper web and a lower web, are built up in layers and interconnected in a mold under pressure and heat.

2. Related Art

A sliding board with a profiled rail system, consisting of at least one rail extending in the longitudinal direction of the sliding board, the rail being connected to the sliding board body by a dowel connection or anchored via at least one formed-on dowel or dowel portion, is known from EP-A-1 161 972. The fastening of the profiled rails is effected on the finished sliding board and consequently only replaces the otherwise usual screw fastening. In order to provide a sliding board with a premounted profiled rail system, it is therefore necessary to carry out fastening and mounting operations on the finished sliding board.

SUMMARY OF THE INVENTION

The invention provides a sliding board which does not have this disadvantage.

According to an aspect of the invention, the disadvantages of the prior art are avoided by virtue of the fact that the anchoring element sits in a receiving location provided in the core and is fixed here during the production of the sliding board by inserting foam material with the anchoring element already inserted.

According to an aspect of the method according to the invention, at least one receiving location is created in the core and in the sliding board components provided above the core, in which location the anchoring element of an interface element to be positioned on the upper shell is inserted, the thus-constructed unfinished sliding board is introduced into the mold, and the receiving location in the core is filled with foam before or during the pressing operation.

The interface elements (at least one interface element), which are the connection to the binding parts to be arranged on the sliding board are therefore according to the invention already integrated into the construction during production of the sliding board. The otherwise usual subsequent fastening operations, such as screwing-on, are thus dispensed with. The production of the sliding board is very simple and above all the activities for arranging bindings—ski bindings or snowboard bindings—are rationalized considerably.

In this connection, the interface elements or their anchoring elements sit at least to a great extent with an exact fit in receiving openings of the sliding board components provided above the core. This measure facilitates positioning of the interface elements during production of the sliding board and prevents undesirable escape of the foamed material during the foaming operation.

The receiving locations in the core can be individual depressions or bores or also elongate receiving grooves or the like running in the longitudinal direction of the sliding board. The invention is therefore suitable for anchoring anchoring elements of different designs and interface elements of different designs.

To support the integration of the anchoring elements in the sliding board body, it is also an advantage if the anchoring elements are provided with structures, such as indentations, grooves, openings or the like, which enlarge their surface area. In one of the possible embodiments, the anchoring elements can be pin-shaped or bolt-shaped parts. However, designs are also possible in which the anchoring elements are elongate projecting parts of the interface elements. In both variants, easy handling in the production of the sliding board is ensured.

According to the invention, interface elements of different design can also be integrated into the sliding board construction. The interface element can thus, for example, be or have a guide element profiled with a rail-like shape or be a plate for arranging binding parts. However, it is also conceivable that the interface element is already a component of the binding.

The core of the sliding board can be made of plastic, plastic foam, wood, light metal, corrugated board, papier mâché or the like or of combinations of these materials. Various core designs are consequently suitable for use for the invention. In this connection, the core can also have at least in part an open structure, for example a honeycomb structure.

BRIEF DESCRIPTION OF THE DRAWINGS

Further features, advantages and details of the invention are described in greater detail with reference to the drawings, which represent diagrammatically illustrative embodiments of the invention and in which.

DETAILED DESCRIPTION OF EMBODIMENTS OF THE INVENTION

Figure 1:
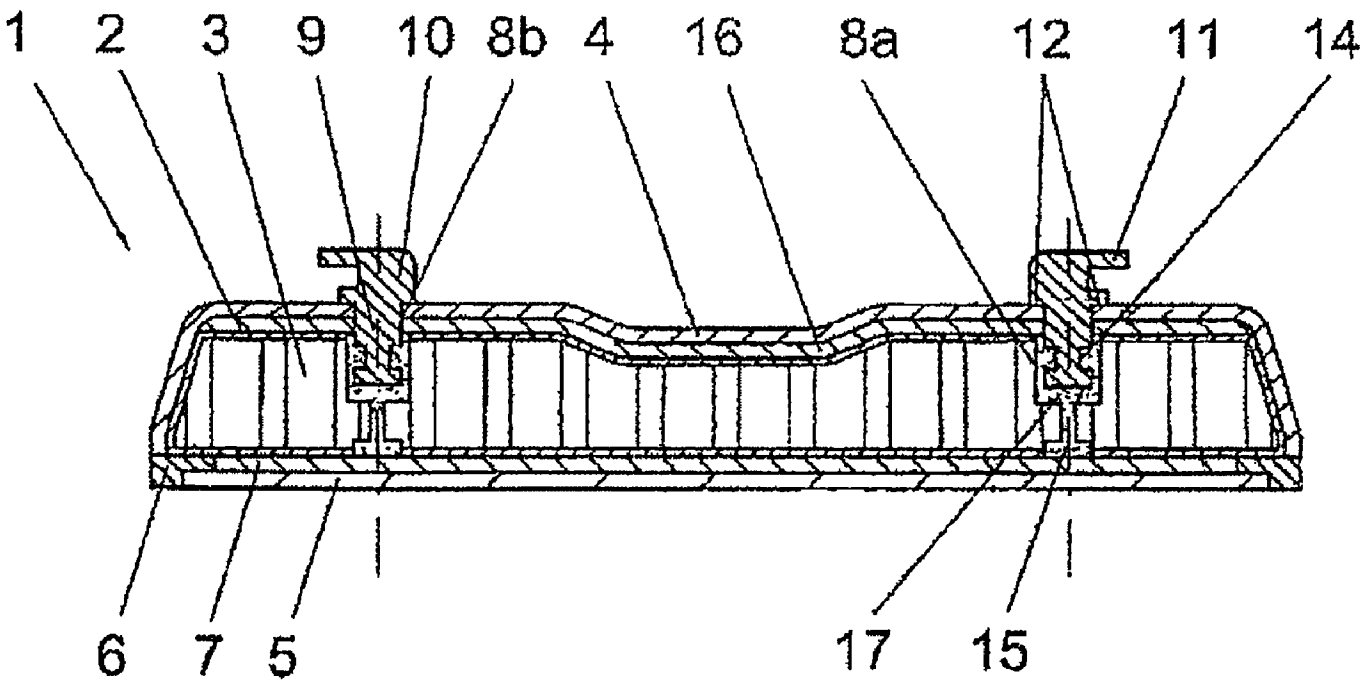
FIG. 1 shows a cross section taken through an embodiment of a ski according to an embodiment of the invention.

FIG. 1 shows a cross section through an embodiment of a ski 1, which has a flexible core 3, an upper shell 4 forming the upper side and the longitudinal sides of the ski 1, a running surface 5, edges 6 made of steel and a lower web 7 arranged between these. Here, the core 3 may be made of wood and is surrounded by a layer 2 made of prepreg. The prepreg layer 2 may be made in a known manner of fabric, scrim or rovings made of fibers, and in particular may be made of glass, aramid or plastic, embedded in plastic material, for example epoxy resin or phenolic resin. The enclosed core 3 forms what is known as the torsion box of the ski 1.

A further layer reinforcing the ski construction, the upper web 16, is located between the upper shell 4 and the layer 2.

The construction of the ski 1 can comprise additional intermediate layers (not illustrated) made of various materials. All the parts of the ski 1 are in particular premolded and prefabricated parts.

Figure 2:
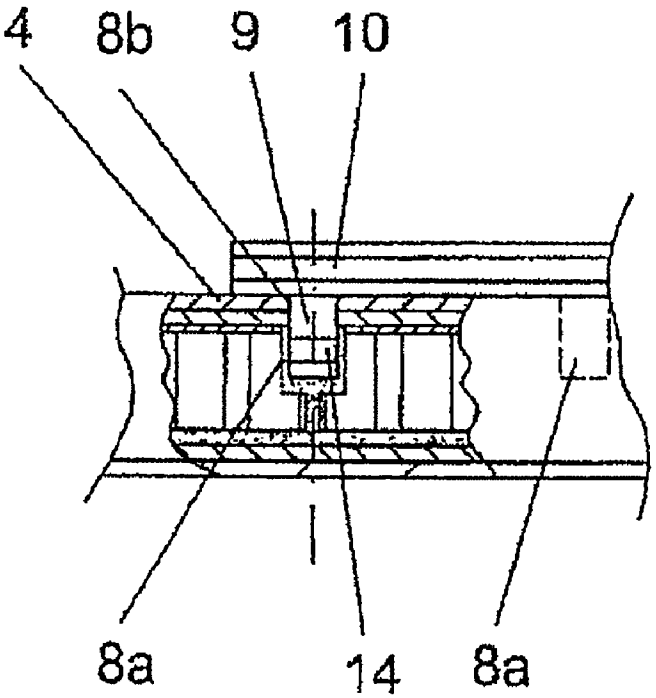
FIG. 2 shows a longitudinal section taken through a part of the ski shown in FIG. 1.

In those regions where a ski binding part is to be arranged, a guide element 10 is held by at least one anchoring element 9 profiled with a rail-like profile which is held or integrated in the core 3 and in the components of the ski 1 provided above the core 3. As FIG. 1 and FIG. 2 show, a number of receiving locations 8*a* in the form of depressions, holes or the like, which are slightly larger with regard to their dimensions—longitudinal and transverse extents and also depth—than the anchoring elements 9 held in them, are provided in the core 3 for each guide element 10. The anchoring elements 9 are in particular cylindrical or have the shape of bolts or pins, other round or angular designs being possible as well. Receiving holes 8*b*, which with regard to their dimensions are adapted to the anchoring elements 9, are designed in the upper shell 4 and the upper web 16.

Figure 3:
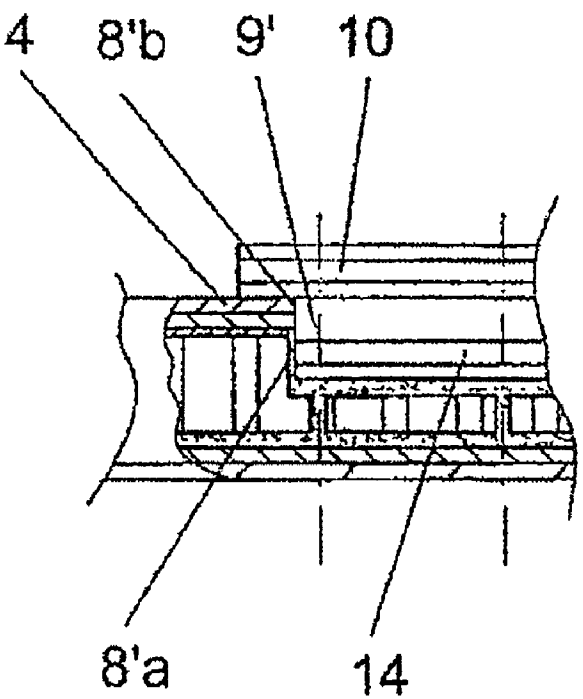
FIG. 3 shows a longitudinal section through a part of a variant embodiment of the invention.

Alternatively, as FIG. 3 shows, receiving locations 8'*a* which run in the longitudinal direction of the ski can be provided by forming elongate depressions in the core 3 and elongate openings or holes in the upper shell 4 and in the upper web 16.

As the drawing figures show, the anchoring elements 9, 9' are integrally comolded components of the guide elements 10 profiled with a rail-like shape. In the embodiment shown, a pair of rail-like guide elements 10 is provided for each ski binding part (not shown). Instead of the rail-like guide elements 10 shown, one-piece profiled rail parts, base-plates with any type of positioning and fixing device for ski binding parts, or another type of plate, can be provided with the anchoring elements 9, 9'.

The guide elements 10 profiled with a rail-like shape shown in the drawing figures may in particular be steel or plastic profiles, which are provided laterally with attached profiled parts 11 which in each case point toward the ski side edges and allow a base-plate or another binding part to be pushed on.

The anchoring elements 9, 9' are also preferably textured by indentations, grooves 14 and the like in order to enlarge their surface area.

The guide elements 10 profiled with a rail-like shape rest on the upper shell 4 with supporting regions 12 at the side of the receiving openings 8*b* and cover the openings in the upper shell. During production of the ski 1, the guide elements 10 are inserted with their anchoring elements 9, 9' in the receiving locations 8*a*, 8*b*, 8'*a*, 8'*b* of the ski components built up in layers, the ski 1 is introduced into a two-part mold for curing and connection of its components, and the mold is closed for a pressing operation. Before or during the pressing operation, foamed material is introduced into the receiving locations 8*a*, 8'*a* via one or more supply ducts 15 provided in the core 3, and then cured. The cured foamed material 17 fixes the anchoring elements 9, 9' in the receiving locations 8*a*, 8'*a* and at the same time brings about the connection of the elements 9, 9' to the core material. The upper shell 4 and the prepreg layer 2 are also connected to the guide elements 10. The indentations 14 support firm integration of the anchoring elements 9, 9' and consequently of the guide elements 10 profiled with a rail-like shape during curing of the foamed material.

The core 3 of a ski 1 made according to the invention can also be made of other materials. Instead of a core made of wood, a core made of high-resistance foam, of plastic (as an injection-molded part or the like), of light metal, of corrugated board or papier mâché can be used. Also possible are composite constructions or honeycomb structures and other open structures or structures with chambers, which can be manufactured from various materials. Combinations of the materials and structures mentioned are likewise possible. In these designs as well, the core and the components provided above the core are provided with receiving locations in the form of depressions, holes, bores, grooves or the like in order to position the anchoring elements of the guide elements and subsequently to fix them with foam material.

The invention has been described with reference to a ski. The invention can of course also find application in other sliding boards, for example snowboards.

Although the present invention has been described in relation to particular embodiments thereof, many other variations and modifications and other uses will become apparent to those skilled in the art. Therefore, the present invention is not limited by the specific disclosure herein.

The invention claimed is:

1. A sliding board comprising a running surface, an upper shell, a core comprising cured foam material, and at least one interface element configured to secure at least one binding element on an upper side of the sliding board, the sliding board comprising:

the at least one interface element comprising at least one anchoring element configured to connect the at least one interface element to the sliding board; and the at least one anchoring element being disposed in a receiving location in the core and being secured in said receiving location by direct contact with the cured foam material.

2. The sliding board as claimed in claim 1, wherein the sliding board further comprises an upper web and a lower web sandwiching the core, and steel edges adjacent to the running surface.

3. The sliding board as claimed in claim 1, wherein the at least one interface element is tightly fitted in a receiving opening formed in said upper shell above the core.

4. The sliding board as claimed in claim 3, wherein said at least one anchoring element of said interface element is tightly fitted in said receiving opening.

5. The sliding board as claimed in claim 1, wherein the receiving location is an individual depression or bore formed in the core.

6. The sliding board as claimed in claim 1, wherein the receiving location is an elongate receiving groove running in a longitudinal direction of the sliding board.

7. The sliding board as claimed in claim 1, wherein the at least one anchoring element is provided with an indentation, groove, recess, or opening which enlarges its surface area.

8. The sliding board as claimed in claim 1, wherein the at least one anchoring element is pin-shaped or bolt-shaped.

9. The sliding board as claimed in claim 1, wherein the at least one anchoring element is an elongate projecting part of the at least one interface element.

10. The sliding board as claimed in claim 1, wherein the at least one interface element has a guide element profiled with a rail-like shape.

11. The sliding board as claimed in claim 1, wherein the at least one interface element has a plate for securing said at least one binding element.

12. The sliding board as claimed in claim 1, wherein the at least one interface element is integrally formed with the at least one binding element.

13. The sliding board as claimed in claim 1, wherein the core comprises at least one material selected from a group consisting of plastic foam, wood, light metal, plastic, corrugated board, papier mâché and combinations of these materials.

14. The sliding board as claimed in claim 1, wherein the core has at least in part an open structure.

15. The sliding board as claimed in claim 1, wherein said sliding board is a ski.

16. The sliding board as claimed in claim 1, wherein said sliding board is a snowboard.

17. A method for the production of a sliding board, the method comprising the steps of:

assembling a sliding board having a running surface, a core, and an upper shell in layers and adhering them together in a mold under pressure and heat;

forming a receiving location in the form of a depression in the core and a corresponding aperture in the upper shell;

inserting an anchoring element fixedly connected to an interface element positioned to secure at least one binding element on the upper shell, the anchoring element inserted through the aperture in the upper shell into the receiving location; and filling said receiving location with a foam material to make direct contact with the anchoring element to secure the anchoring element.

18. The method for the production of a sliding board as claimed in claim 17, wherein said filling step is preformed before placing the sliding board in the mold.

19. The method for the production of a sliding board as claimed in claim 17, wherein said filling step is performed after placing the sliding board in the mold.

20. The method for the production of a sliding board as claimed in claim 19, wherein said filling step is performed before the pressing step.

21. The method for the production of a sliding board as claimed in claim 19, wherein said filling step is performed during the pressing step.

22. The method as claimed in claim 17, further comprising the steps of forming at least one supply duct in the core; and introducing the foam material via said at least one supply duct during the production of the sliding board.

* * * * *